US005449163A

United States Patent [19]

Wong et al.

[11] Patent Number: 5,449,163

[45] Date of Patent: Sep. 12, 1995

[54] FULL PRODUCTIVITY HIGH PERFORMANCE INVERTER

[76] Inventors: Lam F. Wong, 7 Cambray Dr., Fairport, N.Y. 14450; Russell J. Sokac, 5 Tyler Ter., Rochester, N.Y. 14624; Lisbeth S. Quesnel, 27 Widewaters La., Pittsford, N.Y. 14534

[21] Appl. No.: 283,725

[22] Filed: Aug. 1, 1994

[51] Int. Cl.[6] ..... B65H 29/00

[52] U.S. Cl. ..... 271/186; 271/291; 271/65

[58] Field of Search ..... 271/65, 186, 291, 304, 271/902, 223, 225

[56] References Cited

U.S. PATENT DOCUMENTS 4,815,722 3/1989 Sugimoto ..... 271/902 X

FOREIGN PATENT DOCUMENTS 28156 1/1989 Japan ..... 271/225
28465 1/1990 Japan ..... 271/186
286624 11/1993 Japan ..... 271/186

*Primary Examiner*—David H. Bollinger
*Attorney, Agent, or Firm*—William A. Henry, II

[57] ABSTRACT

A full productivity, high performance inverter apparatus includes a sheet input nip, a sheet output nip, a reversing roll nip downstream of the input and output nips, and adjustable interleaving baffles for guiding sheets of a wide variety of lengths between the input nip, output nip, and the reversing nip.

17 Claims, 3 Drawing Sheets

FULL PRODUCTIVITY HIGH PERFORMANCE INVERTER

BACKGROUND OF THE INVENTION

This invention relates to an apparatus for turning over and exchanging lead and trail edges of sheets, and more particularly, to an improved full productivity high performance inverter apparatus that is adjustable in size to accommodate different sheet lengths.

Although a sheet inverter is referred to in the copier/printer art as an "inverter", its function is not necessarily to immediately turn the sheet over (i.e., exchange one face for the other). Its function is to effectively reverse the sheet orientation in its direction of motion. That is, to reverse the lead and trail edge orientation of the sheet. Typically, in inverters as disclosed here, the sheet is driven or fed by feed rollers or other suitable sheet driving mechanisms into a sheet reversing chute. By then reversing the motion of the sheet within the chute and feeding it back out from the chute, the desired reversal of the leading and trailing edges of the sheet in the sheet path is accomplished. Depending on the location and orientation of the inverter in a particular sheet path, this may or may not also accomplish the inversion (turning over) of the sheet. In some applications, for example, where the "inverter" is located at the corner of a 90° to 180° inherent bend in the copy sheet path, the inverter may be used to actually prevent inverting of a sheet at that point, i.e., to maintain the same side of the sheet face-up before and after this bend in the sheet path. On the other hand, if the entering and departing path of the sheet, to and from the inverter, is in substantially the same plane, the sheet will be inverted by the inverter. Thus, inverters have numerous applications in the handling of either original documents or copy sheets to either maintain or change the sheet orientation.

In the field of reprographic machines, depending on the architecture, the finisher setup, and paper path configuration, some simplex printing may require an inverter subsystem in order to deliver copy sheets in 1- N orientation when the sheets are removed from an output tray. One prior art inverter for accomplishing this task is shown in FIG. 1. which shows the conventional configuration of a reversing roll inverter. In order to minimize the straight through (non-inverting) paper path length and to handle sheet sizes from B5 to A3 (sheet lengths: 7" to 17"), this inverter may require the copier/printer to operate in a skip-pitch mode for sheets larger than A4 sizes. This impacts significantly the throughput of larger sheets that require inversion.

The present invention aims at providing an adjustable baffle reversing roll inverter which can adapt to all sheet sizes to maintain full machine productivity. Baffles of the inverter are interleaved so that they can easily be extended or collapsed to accommodate sheets of different lengths.

SUMMARY OF THE INVENTION

Accordingly, the present invention provides a sheet inverter device having an input nip for feeding sheets into a reversing roll nip and an output nip for receiving the sheets from the reversing roll nip and feeding the sheets out of the inverter device. An improvement of the inverter device includes an adjustable chute positioned between the input and output nips and the reversing roll which enables full productivity, and high performance of the inverter device. The adjustable chute has a stationary portion and a slidable portion with the slidable portion being movable in parallel with respect to the stationary portion in order to adjust the length of the adjustable chute to accommodate a wide variety of sheet lengths and thereby maintain full machine productivity.

BRIEF DESCRIPTION OF THE DRAWINGS

The foregoing and other features of the instant invention will be apparent from a further reading of the specification, claims and from the drawings in which:

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

The invention will now be described by reference to a preferred embodiment of the inverter system of the present invention for a copier/printer. However, it should be understood that the sheet inverting method and apparatus of the present invention could be used with any machine in which inversion of a sheet is desired, be that sheet stacking or duplexing.

In general, an improvement to prior sheet inverter systems of machines is disclosed which is cost effective and comprises the use of collapsible baffles in inverting sheets.

Figure 1:
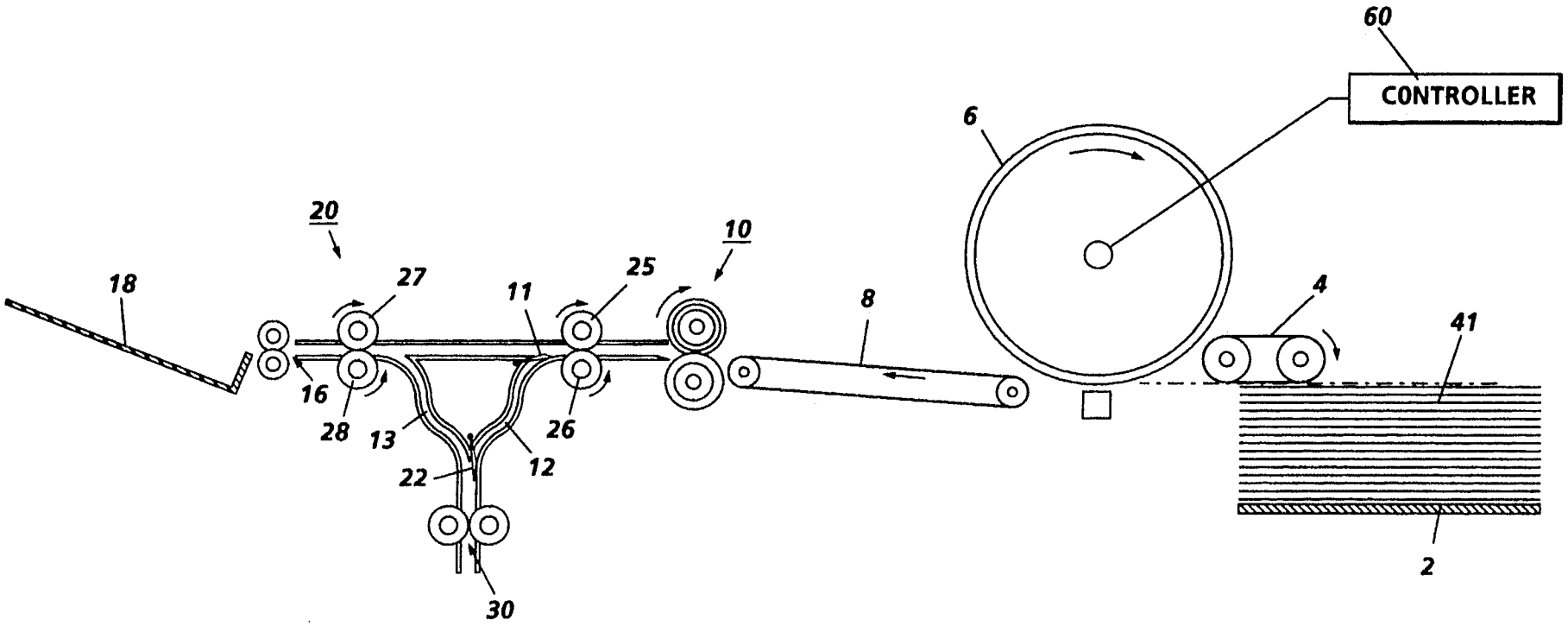
PRIOR ART FIG. 1
FIG. 1 is a schematic of a printing apparatus employing a conventional inverter.

The prior art apparatus shown in FIG. 1 consists basically of means for holding a stack 2 of copy sheets adjacent to a feeder 4 for extracting a sheet from the top of the stack each time a copy is required. Each sheet leaving feeder 4 passes in non-sliding contact with a photoreceptor 6 (shown here in the form of a drum, although it could equally be a belt), from which a particulate material (toner) designed to present a visual contrast with the material of the sheet is transferred from the surface of the photoreceptor to the upper face of the respective sheet 41. After the sheet with the toner image held on it by electrostatic attraction has been detached from the photoreceptor 6, it is conveyed by a conveyor 8 to a fuser 10, which fuses the toner into a permanent bond with the material forming the sheet, by the application of heat and/or pressure.

On leaving the fuser, the sheet is captured by idler roll 25 and drive roll 26 and is either driven through the top of the inverter 20 into a nip formed between idler roll 27 and drive roll 28 which drives the sheet into catch tray 18 or contacts an inverter selection gate 11, if inversion is required, which deflects the sheet down an inclined chute 12 into reversing roll nip 30. An inverter gate 22 closes off chute 12 once the trail edge of a sheet has passed it and prevents the sheet from being driven back into chute 12 by reversing roll 30. The natural resilience of the sheet material is used to flip the freed trail edge of the sheet to the right as viewed, making it immediately clear the pointed end of the structure supporting inverter gate 22 which, at this time, will have been flipped to the left to close off chute 12. Reversing roll nip 30 drives the sheet up inclined chute 13 into a nip formed between idler roll 27 and drive roll 28 which drives the sheet into sheet transport nip 16 for conveying to catch tray 18.

Figure 2:
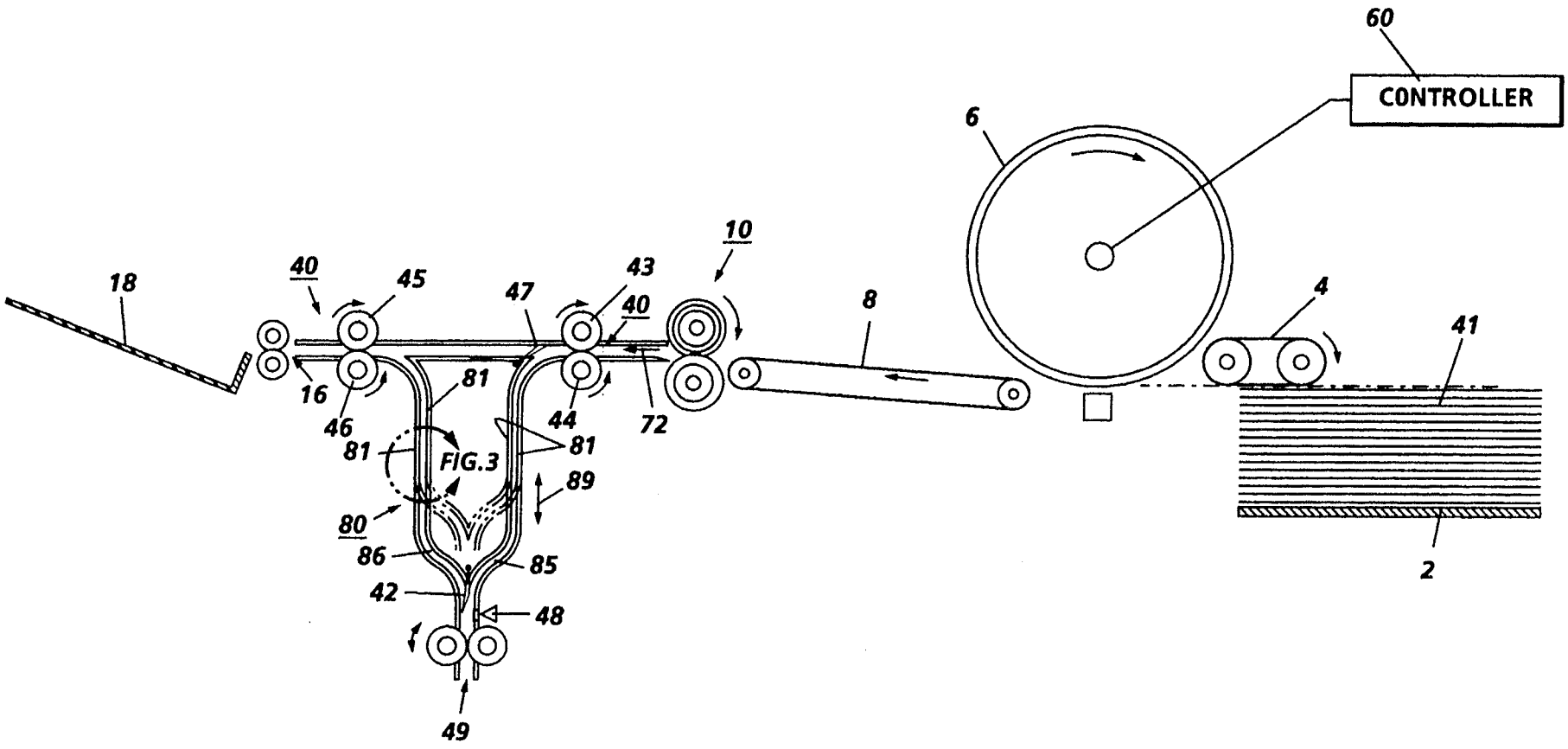
FIG. 2 is a schematic of the printing apparatus of FIG. 1 incorporating the full productivity, high performance inverter apparatus of the present invention therein.
Figure 3:
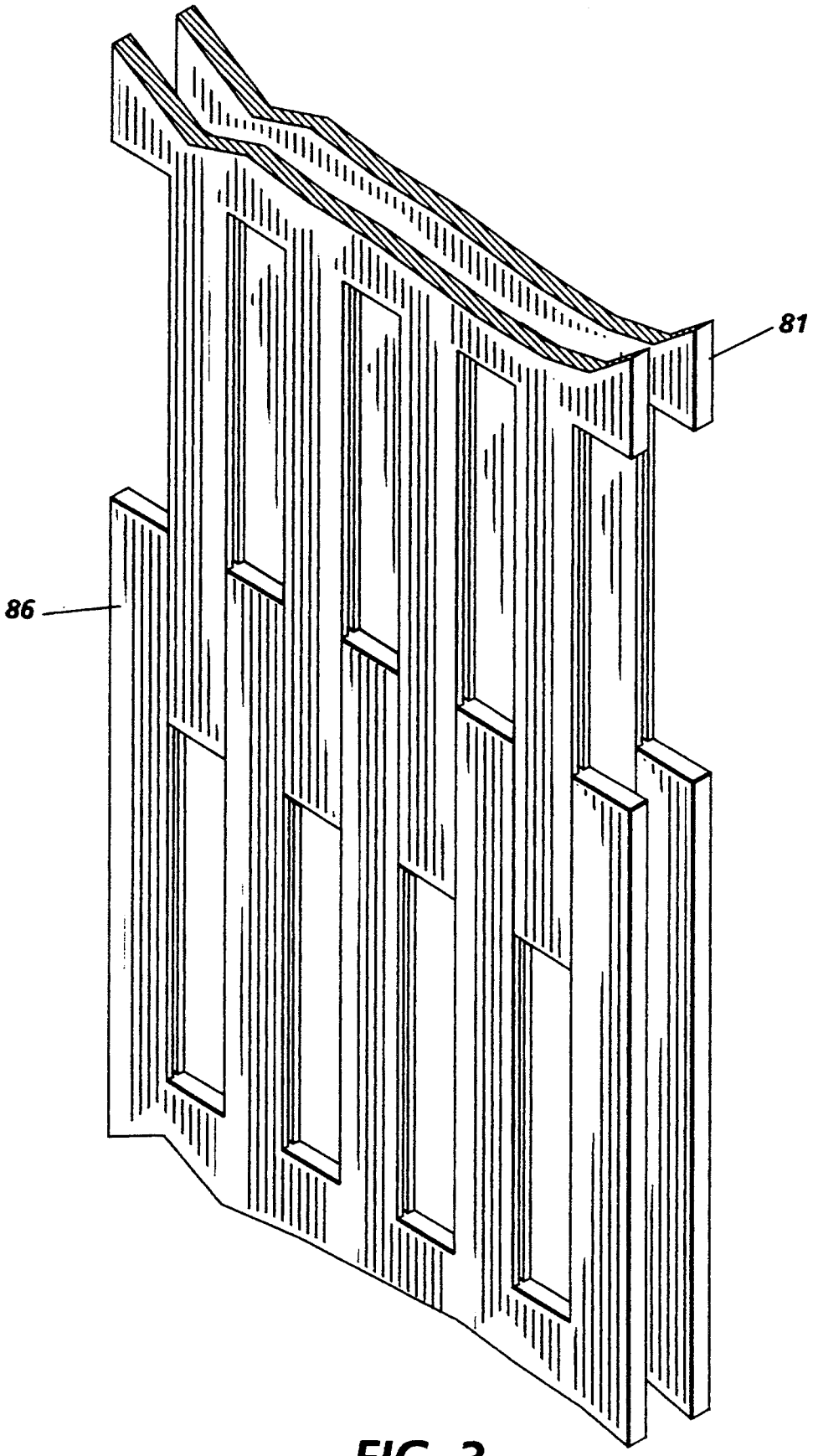
FIG. 3 is a partial schematic showing interdigitated baffle members in an extended position.

Inverter 40 of the present invention in FIG. 2, comprises an idler roll 43 that forms an incoming sheet driving nip with drive roll 44 and is driven in the direction of arrow 72 by drive roll 44 to drive sheets into inverter 40. An outgoing nip for driving sheets out of the inverter is formed between idler roll 45 and drive roll 46. Idler roll 45 of the outgoing nip is driven by drive roll 46 with the nip formed therebetween driving sheets into catch tray 18. Inverter selection gate 47 is positioned downstream of the incoming nip and is controlled by controller 60 to intercept a copy sheet and divert it into the inverter or not intercept a sheet and allow the sheet to pass straight through the inverter and be driven out of the inverter by the outgoing nip towards catch tray 18.

Inverter 40 includes an interdigitated leaving, collapsible, adjustable baffle arrangement that forms a chute for incoming and outgoing sheets and comprises a stationary portion 81 and a movable or slidable portion 86 with the slidable portion 86 being adjustable in the directions of arrow 89 by controller 60 in accordance with the length of copy sheets on which copies are to be made. A reversing roll nip 49 is positioned to receive incoming sheets and drive them into the outgoing nip formed between idler roll 45 and drive roll 46. An inverter gate 42 is adapted to be moved by controller 60 away from the path of incoming sheets and moved into the incoming sheet path after each sheet passes it in order to prevent a sheet from being driven back into the incoming sheet path by reversing roll nip 49. Slidable baffle portion 86 and reversing roll nip 49 are preferably mounted on a conventional carriage (not shown) that is driven by a stepper motor upon actuation by a signal from controller 60 in either direction of arrow 89. It should be understood that any desired conventional mechanical means for moving or sliding the baffle portion 86 and reversing roll nip can be used., e.g., a rack and pinion mechanism.

When the inversion option is selected, adjustable baffle portion 86 is moved into a predetermined position according to the length of the sheets by controller 60 while a copy sheet 41 exiting the fuser 10 enters the inverter 40 lead edge first. The sheet 41 is advanced by the incoming nip formed between idler roll 43 and feed roll 44. Inverter selection gate 47 is actuated by controller 60 to intercept the sheet and divert it down into the inverter chute while it is still under the driving influence of the incoming nip. After the trail edge of the sheet passes inverter gate 42, which is in a closed position and out of the path of the sheet, inverter gate 42 is actuated to block return of the sheet to the incoming sheet path. The sheet is captured and driven further into the inverter by reversing roll nip 49. Once the trail edge of the sheet is sensed by sensor 48, reversing roll nip 49 reverses its direction of rotation and drives the sheet into the outgoing nip formed between idler roll 45 and drive roll 46. The outgoing nip in turn drives the sheet into sheet transporting nip 16 that conveys the sheet to catch tray 18.

Inverter 40 has several advantages over prior inverters in that: it is compact by employing a short paper path for simplex copying; it enables full productivity; it has high reliability due to its lower roll and sheet acceleration and deceleration; and less power is required to invert sheets.

As described above in detail, the adjustable baffle reversing roll inverter of the present invention is adaptable to all sheet sizes to maintain full machine productivity. The baffles are interleaved so that they can easily be extended or collapsed to accommodate sheets of different lengths. The inverter assembly is mounted on a carriage which is configured to slide in and out or up and down depending of the size of copy sheets being used.

It is, therefore, evident that there has been provided in accordance with the present invention an inverter apparatus for copiers/printers or the like which serves to turn over as well as reverse lead and trail edges of sheets thereby fully satisfying the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. In a machine that includes a sheet inverter device having an input nip for feeding sheets into a reversing roll nip and an output nip for receiving the sheets from the reversing roll nip and feeding the sheets out of the inverter device, the improvement of the inverter device, comprising:

an adjustable chute positioned between the input and output nips and the reversing roll nip which enables full productivity, and high performance of the inverter device, said adjustable chute including a pair of walls with each wall having two sets of interdigitated portions with one of said two sets of interdigitated portions being stationary and the other of said two sets of interdigitated portions being slidably movable with respect to said set of stationary interdigitated portions in order to adjust the length of said adjustable chute to accommodate a wide variety of sheet lengths and thereby maintain full machine productivity.

2. The improvement of claim 1, including a controller adapted to move said slidably movable portions of said adjustable chute in accordance with the size of sheets selected on the console of a machine by an operator.

3. The improvement of claim 2, wherein said slidably movable portions of said adjustable chute are mounted on a movable carriage.

4. The improvement of claim 2, including a dual positionable gate adapted when in a first position to direct a sheet into said sheet inverter and when in a second position allows a sheet to pass said sheet inverter without being inverted.

5. A copier/printer capable of printing page image information onto both sides of a wide variety of sheets by use of a full productivity, high performance inverter device, comprising:

an input nip for feeding sheets into the inverter;

an output nip for feeding sheets out of the inverter;

a reversing roll nip for receiving sheets from said input nip and driving them into said output nip;

an adjustable, collapsible chute positioned between said input and output nips which enables full productivity, and high performance of the inverter device, said adjustable chute including a stationary portion having fingers thereon and a slidable portion with fingers thereon that are interlocked with said fingers on said stationary portion, said slidable portion being movable with respect to said stationary portion in order to adjust the length of said adjustable chute to accommodate a wide variety of sheet lengths and thereby maintain full machine productivity; and a controller adapted to control extension and collapse of said adjustable, collapsible chute in accordance with the size of copy sheets to be inverted.

6. The copier/printer of claim 5, wherein said slidable portion of said adjustable, collapsible chute is mounted on a carriage for slidable movement in a predetermined direction.

7. A full productivity, high performance inverter apparatus, comprising: a sheet input nip; a sheet output nip; a reversing roll nip downstream of said input and output nips; and interdigitated baffles for guiding sheets between said input and output nips.

8. The inverter apparatus of claim 7, wherein at least one of said interdigitated baffles is adjustable according to the size of copy sheets to be inverted.

9. The inverter apparatus of claim 8, including a dual positionable gate positioned immediately downstream of said sheet input nip and adapted when in a first position to direct a sheet into said sheet inverter and when in a second position allows a sheet to pass said sheet inverter without being inverted.

10. The improvement of claim 9, including an inverter gate positioned immediately upstream of said reversing roll nip.

11. A sheet inverter device including: an input nip for feeding sheets in a predetermined direction; a reversing roll nip for receiving sheets fed by said input nip and forwarding the sheets in a direction reverse to said predetermined direction; an output nip for receiving the sheets from said reversing roll nip and feeding the sheets out of the inverter device, and an adjustable chute positioned between said input and output nips and said reversing roll nip which enables full productivity, and high performance of the inverter device, said adjustable chute including a stationary portion and a slidable portion with said slidable portion being movable in parallel with respect to said stationary portion in order to adjust the length of said adjustable chute to accommodate a wide variety of sheet lengths and thereby maintain full machine productivity, and wherein both said stationary portion and said slidable portion of said adjustable chute include interdigitated fingers.

12. The sheet inverter of claim 11, including a controller adapted to move said slidable portion of said adjustable chute in accordance with the size of sheets selected on the console of a machine by an operator.

13. The sheet inverter of claim 12, wherein said slidable portion of said adjustable chute is mounted on a movable carriage.

14. The sheet inverter of claim 12, including a dual positionable gate positioned immediately downstream of said input nip and adapted when in a first position to direct a sheet into said sheet inverter and when in a second position allows a sheet to pass said sheet inverter without being inverted.

15. The sheet inverter of claim 14, including an inverter gate positioned immediately upstream of said reversing roll nip.

16. The sheet inverter of claim 15, wherein said inverter gate is positioned immediately upstream of said reversing roll nip.

17. The sheet inverter of claim 12, including a sensor for sensing the trail edge of each sheet and signaling said controller which in turn actuates said reversing rolls to reverse direction of rotation to drive each sheet into said output nip.

* * * * *